United States Patent [19]

Gannon

[11] Patent Number: 4,896,479

[45] Date of Patent: Jan. 30, 1990

[54] PACKAGING PROCESS

[75] Inventor: Raymond Gannon, Farnborough, United Kingdom

[73] Assignee: E.G.L. Projects Limited, Euston Square, United Kingdom

[21] Appl. No.: 372,215

[22] Filed: Jun. 23, 1989

Related U.S. Application Data

[63] Continuation of Ser. No. 150,999, Feb. 1, 1988, abandoned.

[30] Foreign Application Priority Data

Jan. 31, 1987 [GB] United Kingdom ..... 8702206

[51] Int. Cl.[4] ..... B65B 7/28; B65B 31/02; B65B 31/04; B65B 51/10

[52] U.S. Cl. ..... 53/432; 53/471; 53/479

[58] Field of Search ..... 53/268, 403, 405, 408, 53/432, 433, 434, 468, 469, 471, 477, 479, 510, 511, 512

[56] References Cited

U.S. PATENT DOCUMENTS

| | | | |
|---|---|---|---|
| 2,916,059 | 12/1959 | Wong | 53/512 X |
| 3,016,284 | 1/1962 | Trexler | 53/479 X |
| 3,129,545 | 4/1964 | Sloan et al. | 53/511 |
| 3,343,332 | 9/1967 | Mahaffy et al. | 53/433 |
| 3,382,642 | 5/1968 | Shaw | 53/434 |
| 3,498,021 | 3/1970 | Harder et al. | 53/511 |
| 3,695,900 | 10/1972 | Young et al. | 53/479 X |
| 3,744,210 | 7/1973 | O'Lenick et al. | 53/433 |
| 3,832,828 | 9/1974 | Martin | 53/511 |
| 4,137,688 | 2/1979 | Utz et al. | 53/511 X |
| 4,360,996 | 11/1982 | Rutter | 53/268 X |
| 4,534,154 | 8/1985 | Gaubert | 53/479 X |
| 4,777,782 | 10/1988 | Nixon, Jr. et al. | 53/433 |

FOREIGN PATENT DOCUMENTS 949747 2/1964 United Kingdom .

*Primary Examiner*—Robert L. Spruill
*Assistant Examiner*—Beth Bianca
*Attorney, Agent, or Firm*—Darby & Darby

[57] ABSTRACT

A process of packaging goods characterized in that the goods are placed in a container (1) made of flexible thermoplastics sheet material and having a flange (2) provided with an aperture (3), partly closing the container by sealing a deformable sheet material (4) of thermoplastics material to the flange so as to leave unsealed together a part of the flange and the sheet between the aperture and the interior of the container, inserting a conduit member (7) into the aperture so as to separate the unsealed part of the flange and the sheet material, modifying the atmosphere in the container by withdrawing a part of the air in the container and introducing a preserving gas into the container, removing the conduit and sealing together the unsealed part of the sheet material and the flange whereby communication between the aperture (3) and the interior of the container is prevented.

8 Claims, 2 Drawing Sheets

PACKAGING PROCESS

This is a continuation of co-pending application Ser. No. 150,999, filed on Feb. 1, 1988, now abandoned.

This invention relates to a process for the preservation of foodstuffs and other perishable goods.

In our copending British patent application number 8617036, corresponding to copending U.S. application Ser. No. 071,385 filed July 9, 1987, we have described a process of preserving perishable goods in which the goods are placed in a container such as one made of semi-rigid plastic sheet material and provided with a valved aperture. The valve is then connected to a source of preserving gas for example carbon dioxide and also to a source of vacuum. The valve is made conveniently from part of a flange formed in the wall of the tray, and the lid. Air in the container is replaced in small portions at a time by the preserving gas by an electrically operated sequencing device which alternately connects the container for a short period to the source of vacuum and then to the source of preserving gas. The sequencing device controls not only the frequency of the cycle of operations during which air is extracted from the package but also the volume of air or gas which is transferred in any one cycle.

In this way the air in a container which has thin walls and is therefore compressible can be replaced partly and if desired completely by another gas without causing any implosion of the container which would not only disfigure it but could easily damage the contents.

The practicability of this process depends in large measure upon the ability for the container to be connected alternately to sources of preserving gas and vacuum easily, quickly and without recourse to complicated and expensive equipment.

Accordingly this invention provides a process of packaging goods characterised in that the goods are placed in a container made of flexible thermoplastics sheet material and having a flange provided with an aperture partly closing the container by sealing a deformable sheet material of thermoplastics material to the flange so as to leave unsealed together a part of the flange and the sheet between the aperture and the interior of the container, inserting a conduit member into the aperture so as to separate the unsealed part of the flange and the sheet material, modifying the atmosphere in the container by withdrawing a part of the air in the container and introducing a preserving gas into the container, removing the conduit and sealing together the unsealed part of the sheet material and the flange whereby communication between the aperture and the interior of the container is prevented.

This invention is illustrated but not restricted by the following drawings in which FIG. 1 is a view taken in plan showing a preferred form of container for use in the practising of invention process.

Unless the text indicates to the contrary the same numerals identify the same features.

Figure 1:
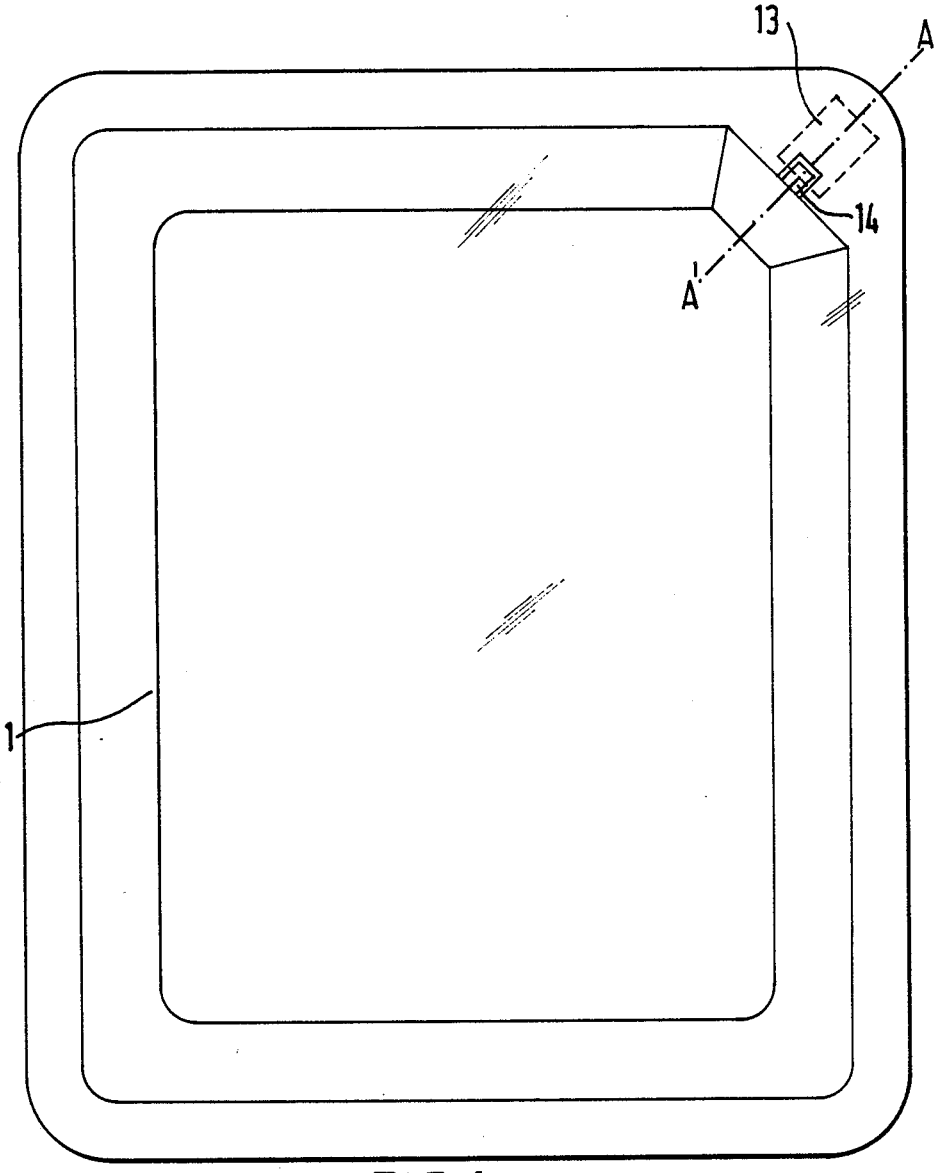
Figure 2:
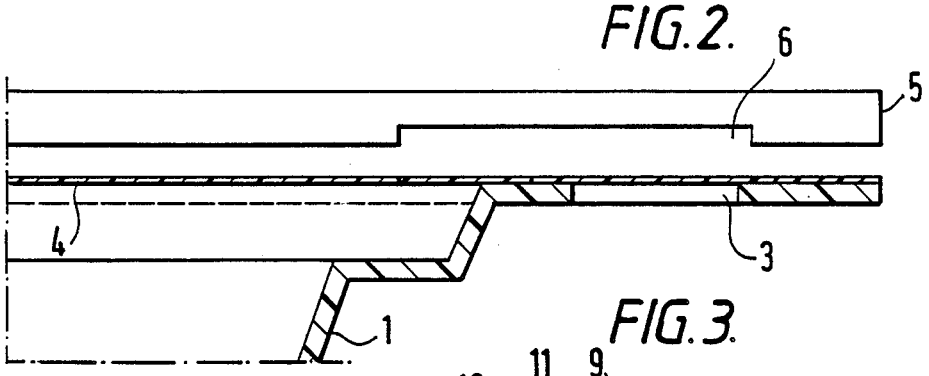
FIG. 2 is a side view taken in vertical section along the line AA' of FIG. 1 showing schematically a step in the sealing of a lid onto the container.
Figure 3:
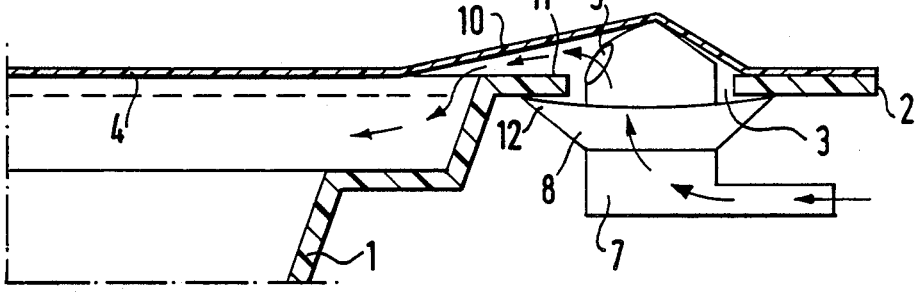
FIG. 3 is a side view taken in vertical section showing along line AA' the conduit member in position.
Figure 4:
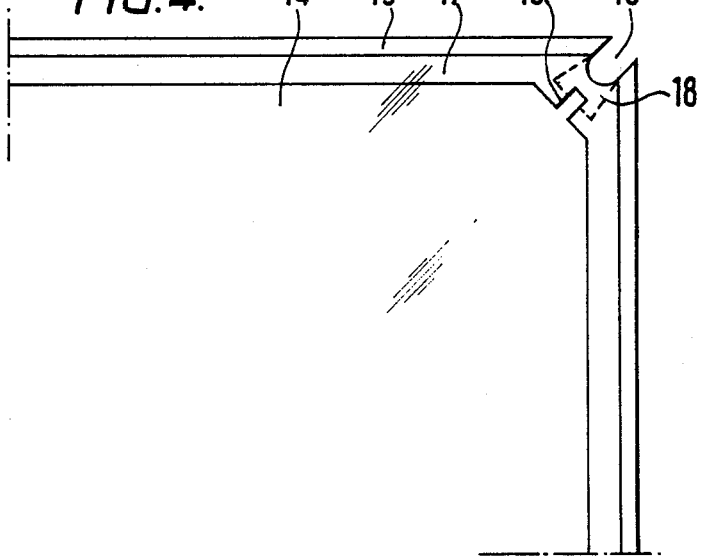
FIG. 4 is a view taken in plan showing a part of an alternative form of container.

In these figures a package comprises a tray (1) made of flexible thermoplastics sheet material which conveniently can be made of polyvinylidene dichloride. The tray is provided with a flange (2) having an aperture (3). When goods to be packaged have been placed in the tray the latter is then lidded by placing a sheet (4) of thermoplastic material, for example also made of polyvinylidene dichloride which is sufficiently large to cover the whole tray including the flange and aperture (3). A hot sealing head (5) having a cut-out portion (6) is then brought into contact with the top of the tray. As a result the sheet is sealed to the flange except in the area (13) of the cut-out portion. The latter includes the area of the aperture and the part of the flange between the aperture and the interior of the container (1). Consequently the aperture is in communication with the interior of the container through a small space between the opposing unsealed parts of the lid and the flange and groove (14) formed into the wall of the container. In order to carry out the process a conduit member (7) provided with a rubber collar (8) and an offset orifice (9) is forced through aperture (3) in the flange (2). Since the sheet of lidding material (4) has not been bonded to the part of the flange forming a shoulder to aperture (3) it is raised away from the flange and as a result communication is established between the interior of the tray (1) through conduit (7) and a sequencer (not shown) to a source of vacuum and a source of preserving gas (also not shown). The collar is provided with a thinner rim portion (12) which conforms readily to the underside of flange (2) and thereby self-sealingly forms an air-tight seal with the flange when the conduit (7) is inserted through the aperture. The sequencer is then programmed so as alternately to extract small quantities of air for example about 5% to 15% and preferably about 10% of the air in the container in one cycle and to replace the air extracted with approximately an equal volume of preserving gas until the composition of gas within the container has reached a predetermined value. At this stage the conduit member (7) is removed and a second hot sealing head is applied to the unsealed part (10) of the lid (4) to the shoulder (11) of flange (2). During the whole process there is such small variation of pressure within the container that there is little danger of the package becoming disfigured by crushing by atmospheric pressure or the contents of the container being damaged.

A number of steps in the process namely those involving the lidding of the tray, insertion of the conduit and final sealing of the package can be carried out manually although automatic or semi-automatic methods are preferred. However, in each case the atmosphere in the package is modified utilising a source of preserving gas the flow of which into the package is controlled by automatic sequencing means in a series of pulses between which small quantities of air are abstracted from the package. When the process is carried out by semi-automatic or automatic means a more convenient method of connecting the conduit with the container is to use a container a part of which is illustrated in FIG. 5. In this figure a container (14) has a flange (15) provided with a notch or cut-out portion (16). When the goods have been placed in the container a sheet of deformable material (17) is sealed over the flange except in the area (18). Consequently there is communication from outside the container in area (18) between the unsealed part of the sheet material and the flange with the interior of the container. To assist this communication the wall of the container is provided with a small groove (19). In order to connect the conduit with the container the head of the conduit is slid into the notch and in so doing the unsealed part of the sheet material and flange become separated and the collar of the conduit forms an air-tight engagement with the curved end of the notch. When the atmosphere in the container has been modified the conduit is removed and the unsealed part of the sheet material and the flange is sealed in the usual way thus completing the closure of the container. In semi-automatic of automatic processes it is generally easier and more convenient to connect the conduit by a sliding action with the container rather than by insertion of the conduit through an aperture as described above.

I claim:

1. A process of packaging goods, which comprises placing the goods in a container (1) made of flexible thermoplastic sheet material and having a flange (2) provided with an aperture (3), partly closing the container by sealing a deformable sheet material (4) of thermoplastic material to the flange so as to leave unsealed together a part of the flange and the sheet material between the aperture and the interior of the container, inserting a conduit member (7) into the aperture so as to separate the unsealed part of the flange and the sheet material thereby and so as to form an air-tight sealing engagement connection between the conduit member and the flange at the aperture for flow communicating the conduit member with the interior of the container through the unsealed part of the flange and the sheet material, modifying the atmosphere in the container by withdrawing a part of the air in the container and introducing a preserving gas into the container via the conduit member so as to exchange the air in the container by the preserving gas, removing the conduit member, and sealing together the unsealed part of the sheet material and the flange whereby communication between the aperture (3) and the interior of the container is prevented.

2. Process of claim 1 wherein the aperture is a notch.

3. Process of claim 1 wherein the conduit is provided with a sealing collar for effecting said air-tight sealing engagement connection in self-sealing manner.

4. Process of claim 1 wherein the conduit is connected to a source both of a vacuum and a preserving gas.

5. Process of claim 4 wherein small quantities of air are withdrawn from the container and replaced by small quantities of a preserving gas in a series of successive incremental alternating air withdrawal and preserving gas replacement steps for gradual exchange of the air by the preserving gas.

6. Process of claim 1 wherein small quantities of air are withdrawn from the container and replaced by small quantities of a preserving gas in a series of successive incremental alternating air withdrawal and preserving gas replacement steps for gradual exchange of the air by the preserving gas in substantially equivalent amounts so as to effect the whole exchange at such small variation of pressure within the container as to minimize the danger of the package becoming disfigured by crushing by atmospheric pressure or the contents of the container being damaged.

7. Process of packaging goods, which comprises placing the goods in a container made of flexible sheet material and having a flange provided with an aperture, partly closing the container by sealing a deformable cover sheet to the flange so as to leave unsealed together a part of the flange and the cover sheet between the aperture and the interior of the container, inserting a self-sealingly engaging conduit member into the aperture so as to separate the unsealed part of the flange and the cover sheet thereby and so as to form an air-tight sealing engagement connection between the conduit member and the flange at the aperture for flow communicating the conduit member with the interior of the container through the unsealed part of the flange and the cover sheet, modifying the atmosphere in the container by withdrawing a part of the air in the container and introducing a preserving gas into the container via the conduit member so as to exchange the air in the container by the preserving gas, removing the conduit member, and sealing together the unsealed part of the cover sheet and the flange whereby communication between the aperture and the interior of the container is prevented.

8. Process of claim 7 wherein small quantities of air are withdrawn from the container and replaced by small quantities of a preserving gas in a series of successive incremental alternating air withdrawal and preserving gas replacement steps for gradual exchange of the air by the preserving gas in substantially equivalent amounts so as to effect the whole exchange at such small variation of pressure within the container as to minimize the danger of the package becoming disfigured by crushing by atmospheric pressure or the contents of the container being damaged.

* * * * *